US007431829B2

(12) United States Patent
Aramburu

(10) Patent No.: US 7,431,829 B2
(45) Date of Patent: Oct. 7, 2008

(54) METHOD FOR REGENERATING USED OILS BY DEMETALLIZATION AND DISTILLATION

(75) Inventor: Jeronimo Angulo Aramburu, Madrid (ES)

(73) Assignee: Sener Grupo De Ingenieria, S.A., Madrid (ES)

( * ) Notice: Subject to any disclaimer, the term of this patent is extended or adjusted under 35 U.S.C. 154(b) by 371 days.

(21) Appl. No.: 10/573,012

(22) PCT Filed: Sep. 23, 2004

(86) PCT No.: PCT/ES2004/000418

§ 371 (c)(1),
(2), (4) Date: Mar. 22, 2006

(87) PCT Pub. No.: WO2005/028600

PCT Pub. Date: Mar. 31, 2005

(65) Prior Publication Data

US 2007/0039853 A1 Feb. 22, 2007

(30) Foreign Application Priority Data

Sep. 23, 2003 (ES) ..... 200302203

(51) Int. Cl.
*C10G 17/00* (2006.01)

(52) U.S. Cl. ..... 208/251 R; 208/252; 208/253; 208/255

(58) Field of Classification Search ..... 208/251 R
See application file for complete search history.

(56) References Cited

U.S. PATENT DOCUMENTS 3,879,282 A * 4/1975 Johnson ..... 208/184
3,930,988 A * 1/1976 Johnson ..... 208/182
4,151,072 A * 4/1979 Nowack et al. ..... 208/182
4,204,946 A * 5/1980 Johnson ..... 208/181
4,224,142 A * 9/1980 Benedict ..... 208/179
4,247,389 A 1/1981 Johnson et al.
4,411,774 A * 10/1983 Johnson ..... 208/179
4,420,389 A * 12/1983 Beckworth et al. ..... 208/251 R
4,834,868 A 5/1989 Lappin
5,759,385 A 6/1998 Aussillous et al.
5,795,463 A * 8/1998 Prokopowicz ..... 208/251 R
6,072,065 A 6/2000 Chavet
6,117,306 A 9/2000 Morel et al.

FOREIGN PATENT DOCUMENTS

| | | |
|---|---|---|
| DE | 3433336 | 3/1985 |
| ES | 2 124 879 | 2/1999 |
| ES | 2 125 208 | 3/1999 |
| ES | 2 169 748 | 7/2002 |

(Continued)

*Primary Examiner*—Tam M. Nguyen
(74) *Attorney, Agent, or Firm*—Katten Muchin Rosenman LLP

(57) ABSTRACT

The present invention refers to a method for the regeneration of used petroleum oils which comprises the following steps:

(a) demetallization of the used mineral oil by means of chemical treatment of said oil with an aqueous solution of a chemical reagent containing anions which form low solubility salts with the metals of the oil, followed by the separation of the demetallized oil;

(b) distillation of the demetallized oil obtained in step (a) at atmospheric pressure and in the presence of alkaline hydroxides; and (c) distillation of the bottom liquid obtained in the atmospheric distillation in step (b) under vacuum and in the presence of alkaline hydroxides to obtain lubricant bases.

13 Claims, 1 Drawing Sheet

FOREIGN PATENT DOCUMENTS

| | | |
|---|---|---|
| FR | 2 552 098 | 3/1985 |
| WO | WO 94/07798 | 4/1994 |
| WO | WO 94/21761 | 9/1994 |
| WO | WO 98/26031 | 6/1998 |
| WO | WO 2004/007644 | 1/2004 |

* cited by examiner

METHOD FOR REGENERATING USED OILS BY DEMETALLIZATION AND DISTILLATION

This application is the National Stage of International Application No. PCT/ES2004/000418, filed Sep. 23, 2004, which claims the benefit under 35 U.S.C. 119 (a-e) of P200302203 filed Sep. 23, 2003, which is herein incorporated by reference.

FIELD OF THE INVENTION

The invention, in general, is associated with the regeneration of used oils; an industrial operation which consists in recovering the base oils by separating them from the additives, from their degradation products and from the contaminants acquired during its use or collection. More specifically, the invention refers to a method for regenerating used petroleum oils by demetallization and distillation.

The refined petroleum oils which are used to make lubricants and other industrial oils are called lubricant bases.

The lubricants and other industrial oils are formulated by mixing the lubricant bases with additives, some of which contain metals (Ca, Zn, etc.), which confer them the qualities demanded by the service they have to provide (resistance to oxidation, to shearing and to temperature, emulsifying and anti-foaming properties, low variability of viscosity with temperature, etc.).

The discarded oils, after their use in motors and other machines, are called used oils. The regeneration of used oils consists in recovering the lubricant bases by separating them from the additives as well as from their degradation products (lighter petroleum fractions such as naphtha and gas-oil, and heavier ones such as asphalts and coke) and the contaminants acquired in their use or collection, in garages and petrol stations, such as water, glycols and solvents.

BACKGROUND OF THE INVENTION

The separation of the additives, degradation products and contaminants of used oils is normally carried out by distillation methods. In the patent WO 9407798 (Viscolube Italiana Sp, 1994) a typical distillation method is described which uses high temperatures under vacuum distillation (around 350° C.) with the aim of breaking down the additives, which also deteriorates the lubricant bases, which acquire colour and odour and contain oxygenated products. To obtain quality lubricant bases by distillation at high temperature it is necessary to use final refining treatments with acid and earths or by hydrogenation, which are onerous and complicated.

Also, the high temperatures employed cause fouling of the industrial equipment, which involves stopping the process for cleaning.

As an alternative to the separation of the additives by distillation, the chemical demetallization has been developed by reacting the metal additives of the used oil with reagents that form metal salts. Thus, in the patent U.S. Pat. No. 4,247,389 (Phillips Petroleum US, 1981) the used oil is treated with solutions of ammonium phosphate at temperatures of 320-420° C. However, the demetallization treatment at these temperatures and the subsequent distillation of the demetallized oil also produce odour and colour and yield unstable products, which require treating the bases obtained by hydrogenation or by adsorbents, with the already indicated disadvantages of these final refining processes.

On the other hand, there are some references to the use of alkaline hydroxides in the regeneration of used oils. Thus, in patent DE 3433336 (BUSS AG, 1985) treatment with alkaline hydroxides is employed on the used oils before proceeding to the separation of the additives and asphalts by distillation.

Other methods use alkaline treatment of the lubricant fractions obtained after separating the additives and asphalts by distillation (US 4834868, F. J. Lappin 1989, and WO 9826031, Sotulub, Tunisia 1997); or by extraction with solvents and distillation (PCT/ES02/00354 Sener, Spain 2002), achieving in this way lubricant bases which do not require final refining treatments by acid/earths or hydrogenation.

However, no antecedents have been about methods which use treatments with alkaline hydroxides before, during or after chemical demetallization of used oils.

The present invention consists in a method of chemical demetallization followed by a distillation process of the demetallized product in the presence of alkaline hydroxides, both carried out at moderate temperatures in such conditions that lubricant bases are obtained with good characteristics of odour and colour, acidity and copper corrosion test and complying with other typical specifications of lubricant bases of first refining.

OBJECT OF THE INVENTION

The present invention has as its objective to regenerate used oils by means of a chemical demetallization process which does not require costly treatments by hydrogenation or by acid and earths, to obtain lubricant bases which comply which the specifications of virgin base oils.

The objective of the method is also to carry out the regeneration under moderate temperature conditions in a way which will avoid fouling of the equipment and the need for frequent cleaning in installations for used oil treatment.

Likewise it is the objective of the method that the regeneration is carried out without producing emissions and odours and without generating polluting solid wastes (acid residues, adsorbent earths, etc.).

Finally, it is also the objective of the present invention to carry out the regeneration of used oils by means of a continuous industrial process which should require a low investment and have moderate operational costs, with high returns, with the aim of making competitive installations of moderate capacity (15,000-30,000 t/y).

DETAILED DESCRIPTION OF THE INVENTION

The present invention provides a method for the regeneration of used mineral oils for obtaining lubricant bases which comprises the following steps:

(a) demetallization of the used mineral oil by means of chemical treatment of said oil with an aqueous solution of a chemical reagent containing anions which form low solubility salts with the metals of the oil, followed by the separation of the demetallized oil;

(b) distillation of the demetallized oil obtained in step (a) at atmospheric pressure and in the presence of alkaline hydroxides; and (c) distillation of the bottom liquid obtained in the atmospheric distillation of step (b) under vacuum and in the presence of alkaline hydroxides to obtain lubricant bases.

Said method can be carried out in continuous mode or discontinuous mode, preferably in continuous mode.

The term "low solubility salts" in the context of the invention refers to salts which tend to precipitate in the medium in which they are dissolved.

It has been verified experimentally that the elimination of the metals from the additives takes place with reasonable demetallization yields (achieving a content in metals of about 100 ppm), when the oils are treated with ammonium phosphates (mono or diammonium) at moderate temperatures (120-180° C.). This enables the operation to be carried out without deterioration of the base oils, by avoiding the temperatures described in the literature (around 350° C.) for achieving high demetallization yields (content in metals less than 10 ppm). Other ammonium salts, whose anions have the property of forming insoluble or low solubility salts in water with metals present in used oils, are equally effective as reagents in the demetallization. Thus, for example, besides the already mentioned mono- and diammonium phosphate, triammonium phosphate, the mono- and diammonium sulphates, ammonium bisulphate and ammonium polyphosphates or mixtures of these salts whose anions form insoluble or low solubility salts with the metals of the additives (mainly Ca, Zn and Mg) or with other metals present in used oils (Pb, Fe, Cu and others) can be used.

So, in a particular embodiment of the method of the invention, the chemical reagent employed in step (a) is an ammonium salt; said reagent being used in a proportion of 0.5% to 5% by weight of ammonium salt in relation to the used oil.

In another particular embodiment, said ammonium salt contains anions of the phosphate and sulphate groups, and can be mono-ammonium or diammonium phosphate, or mono-ammonium or diammonium sulphate, or a mixture thereof.

In a particular embodiment of the method of the invention, the chemical treatment of step (a) is carried out in a continuous way in tubular reactors, or in one or several well-mixed reactors in series or in a combination of both systems, and in which the reaction is carried out at temperatures between 120° C. and 180° C., at pressures between 3 and 11 bar and with residence times between 10 and 120 minutes.

In another embodiment of the invention, the separation of step (a) is carried out continuously by means of an adiabatic decompression which produces flash vaporisation, so that at least a part of the water and the light hydrocarbons and solvents is vaporised. These light hydrocarbons and solvents are collected and decanted after their condensation.

The liquid obtained after the decompression and flash vaporisation is cooled and separated into a sludge which containing the metal salts, an aqueous phase with excess of reagent and the demetallized oil. The separation of the demetallized oil from the sludge of metal salts is carried out preferably by continuous centrifugation in one or two steps in series.

Likewise, it has been verified that when the oils demetallized in this way are distilled at moderate temperatures in the presence of alkaline hydroxides, lubricant bases of a quality equal to that of virgin bases of first refining is achieved, avoiding the final treatments with acid and earths or by hydrogenation, which are necessary when using high temperatures in the demetallization and in the distillation.

Therefore, in another embodiment of the method of the invention, in step (b) the demetallized oil is distilled continuously at atmospheric pressure in the presence of alkaline hydroxides, so that the remains of water, light hydrocarbons and solvents are distilled, together with the ammonia released by the effect of the alkaline hydroxides.

In another particular embodiment, the distillate is subjected to condensation, followed by decanting, in such a way that an organic phase is obtained which contains light hydrocarbons and solvents, and an aqueous phase which contains ammonia. The non-condensables of the distillate are washed with water or with an aqueous solution of an acid to retain the ammonia in aqueous solution, which is added to the aqueous ammonia phase obtained previously.

In order to carry out this atmospheric distillation in a simple way and to subject the product to the least possible degradation, this operation of distillation at atmospheric pressure is carried out by indirect heating by means of a thermal fluid at temperatures below 300° C. Preferably, said atmospheric distillation is carried out in a continuous way subjecting the demetallized oil to flash vaporisation at temperatures between 200 and 300° C.

In another embodiment of the invention, in step (c) the bottom liquid obtained in the atmospheric distillation of step (b) is distilled continuously under vacuum in a rectification column in the presence of alkaline hydroxides, preferably at a pressure between 2 and 10 mbar at the top of the column and a column feed temperature between 310 and 335° C., obtaining as side cuts a vacuum gas-oil, one or several fractions of lubricant bases and a bottom with characteristics of fuel-oil or an asphalt component.

Likewise, in the method of the invention, for carrying out the vacuum distillation of step (c) under mild conditions (temperatures lower than 330° C.), the fractionating column operates preferably at low pressure (2 to 10 mbar in the head), with low pressure loss (packed column instead of valve or perforated plates) and by heating the feed to the column by means of a thermal oil at a temperature less than 385° C. in a tubular heat exchanger, designed for high fluid velocity in the tubes.

Similarly, the atmospheric distillation of step (b) is preferably performed in a tubular heat exchanger with high fluid velocity through the tubes, a thermal oil preferably at a temperature less than 300° C. being the heating fluid which circulates outside these tubes.

So, in a particular embodiment of the invention, the distillations of steps (b) and (c), that is, the distillation at atmospheric pressure and the vacuum distillation, are carried out in tubular heat exchangers, in which the demetallized oil obtained in step (a), or the bottom liquid obtained in the atmospheric distillation of step (b), circulates at high speed inside the tubes and in which the heating fluid on the outside of these tubes is a thermal oil which circulates preferably at temperatures lower than 300° C. in the atmospheric distillation and lower than 385° C. in the vacuum distillation.

Another characteristic of the method claimed is the use of proportions of alkaline hydroxides between 0.5% and 5% by weight of oil, higher than that described in the literature (generally lower than 0.5% by weight), since sufficient hydroxide is required to displace the ammonia in the demetallized oil.

Thus, in another particular embodiment of the method of the invention, the alkaline hydroxide used in steps (b) and (c) is sodium hydroxide or potassium hydroxide or a mixture of both, which is added in a proportion of 0.5% to 5% by weight in relation to the demetallized oil, more preferably in a proportion of 0.5% to 3%, so that said addition is carried out completely before the atmospheric distillation, or a part before the atmospheric distillation and a part before the vacuum distillation.

Figure 1:
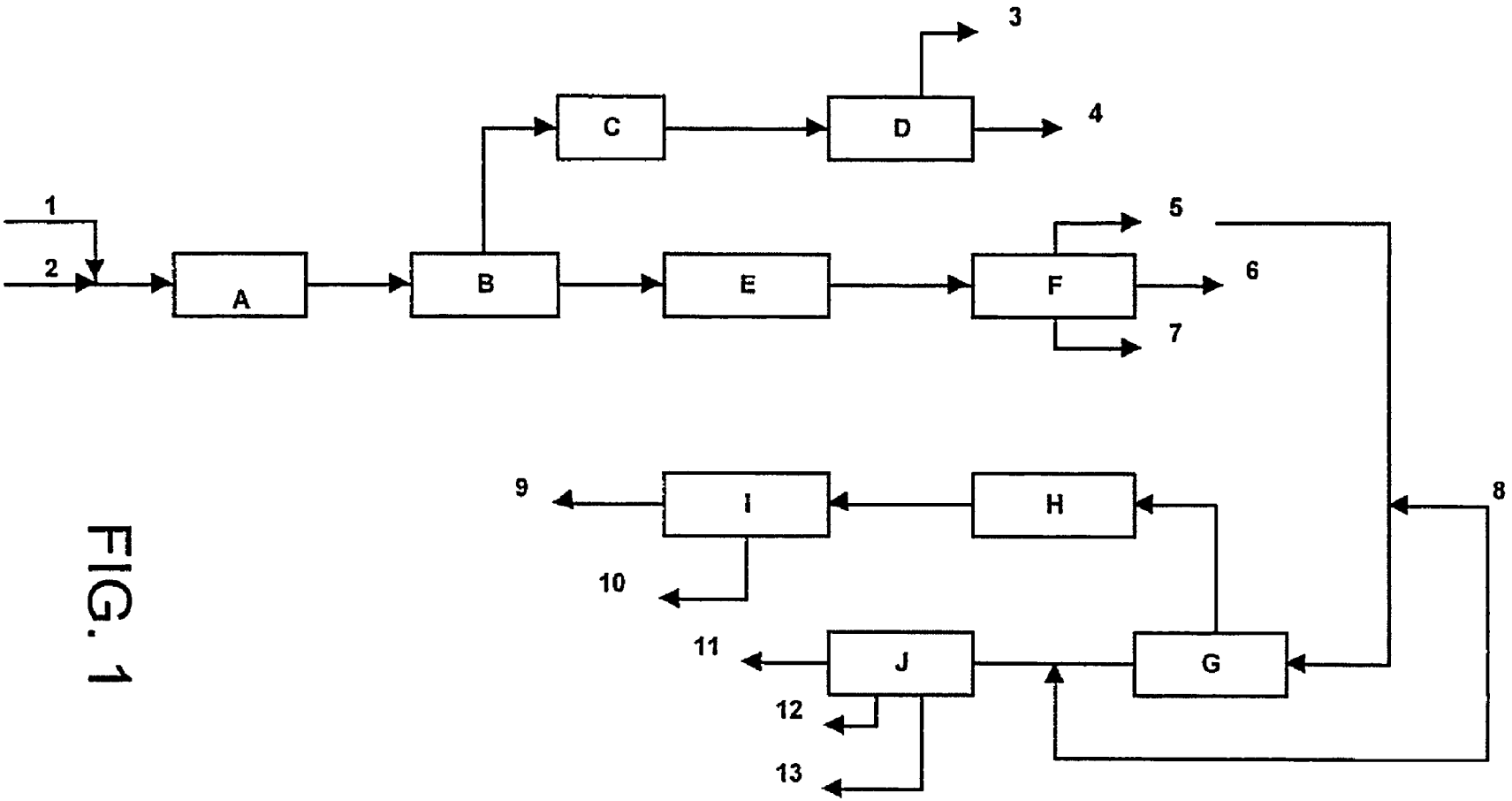
FIG. 1 attached illustrates the method of the invention, carried out continuously, as is described below.

The current of used oil to be regenerated (1) and the chemical reagent (2), an aqueous solution of ammonium phosphate, for example, are introduced into the reaction device (A) where they react to form metal salts.

As has been mentioned previously, the reaction device (A) could be a tubular reactor, one or several agitated reactors in series, or a combination of both, where the reaction is preferably carried out at pressure and continuously.

The product which flows from the reaction device (A) is subjected to decompression in (B), some vapours being separated which are condensed in (C) and decanted into two phases in (D), to give rise to an organic phase (3) of light hydrocarbons and solvents (in the petrol and kerosene range) and an aqueous phase (4).

The liquid resulting from the decompression in (B) is cooled down in (E) and passes to the phase separation system (F). Although the phase separation system (F) can be a combination of decanting, filtration and centrifugation techniques, in the method of the present invention the separation of an oily sludge which contains the metal salts (6), an aqueous phase with excess reagent (7), and the demetallized oil (5), are achieved advantageously by continuous centrifugation in one or two centrifuges in series.

The aqueous solution which contains the excess reagent (7) can be recycled, at least partly, to prepare the chemical reagent again (1), while the liquid phase which contains the metal salts (6) is sent to a waste treatment plant for its subsequent processing.

The demetallized oil (5), mixed with the alkaline hydroxide (8) is subjected to continuous atmospheric distillation in (G), some vapours being obtained which are condensed in (H) and decanted in (I), obtaining in this way an organic phase (9) of hydrocarbons and solvents, of a higher boiling point than those separated in the current (3), in the range of kerosene and light gas-oil, and an aqueous phase (10) which contains the ammonia displaced by the alkaline reagent. The non-condensables from the decanter (I) are washed with water or an aqueous solution of an acid to retain the ammonia which is added to the aqueous ammonia solution (10) obtained previously.

The bottom of the atmospheric distillation, optionally with a second addition of alkaline hydroxide (8), is subjected to rectification in a vacuum distillation column (J), thus separating a vacuum gas-oil (11), one or several side cuts of lubricant bases (12) (SN-150 and SN-350, for example) and a column bottom (13) which has characteristics of fuel-oil or of an asphalt component.

EXAMPLES

The examples which are shown below illustrate the method with their embodiment not necessarily constituting the limits of the possibilities of the invention.

As used oil a product is employed with the following characteristics:

Colour: dark
Viscosity (ASTM D 445) at 100° C.: 13.3 cSt.
Water (ASTM D 95): 5% by weight
Metals: 3,500 ppm (Ca 1,750 ppm, Zn 854 ppm).
Distillation ASTM D 1160
I.P.=228° C.
F.P.=520° C.
Distilled volume: 88%

Example No. 1 (Conventional Demetallization and Distillation Treatment)

1000 g of used oil is mixed with a saturated aqueous solution which contains 25 g of diammonium phosphate and is heated for 60 minutes at 150° C. in an autoclave at 6 bar provided with mechanical agitation.

After the reaction, the autoclave is decompressed, condensing the vapours by means of a refrigerant and collecting an aqueous condensate from which 20 g of light hydrocarbons and chlorinated products is separated by decanting.

The contents of the autoclave, after decompression, is cooled down to ambient temperature and is centrifuged, separating 30 g of a sludge containing metal phosphates (zinc, calcium, etc.), the aqueous phase containing the excess ammonium phosphate and 910 g of demetallized oil containing 123 ppm of metals (Zn: 30 ppm; Ca: 39 ppm).

The 910 g of demetallized oil is distilled at atmospheric pressure until it reaches 280° C. Thus 35 g of an organic phase (light gas-oil, solvents, etc.) are obtained from which distilled water is decanted leaving a distillation bottom which contains the demetallized oil.

Next, the bottom is vacuum distilled (15 mm Hg) obtaining 61 g of heavy gas-oil, 393 g of light base oil and 306 g of heavy base oil leaving in the distillation flask a bottom of 114 g of fuel-oil or an asphalt component.

The base oils obtained have a strong colour (2.5 to 5.0) and odour, an acidity greater than 0.1 mg KOH/g and its IR spectrum showing a notable concentration of oxygenated products in the 1700-1730 $cm^{-1}$ band, requiring an additional treatment with adsorbent earths or by hydrogenation, to comply with the typical specifications of virgin lubricant bases.

To verify this aspect, 250 $cm^3$ of SN-350 oil obtained were taken (colour: 5.5, acidity: 0.14) and were treated with 4% diatomaceous earths and 1% CaO for 20 minutes at 130° C.; after the reaction the mixture was cooled down and filtered through a sintered glass disc.

The oil obtained had a colour of 2.5, an acidity of 0.04 and a light odour.

The recovery in lubricant fractions is 74% by weight of the starting used oil on a dry basis, before these additional treatments with earths, and 72% after treatment with earths.

Example No. 1 shows that carrying out the distillation of the demetallized oil in low temperature conditions, an oil base is obtained with good recoveries, but with characteristics which still require a final treatment with earths or by hydrogenation.

Example No. 2 (Treatment According to the Claimed Method)

1000 g of used oil has is demetallized as shown in example 1.

The 910 g of demetallized oil is mixed with a saturated solution of potassium hydroxide containing 25 g of potassium hydroxide and is distilled at atmospheric pressure until reaching 280° C.

The distillate is collected over water to retain the ammonia released. Thus an ammonium solution is obtained containing 15 g of ammonia, from which is decanted 33 g of an organic phase containing kerosene, light gas-oil and solvents.

The bottom of the atmospheric distillation containing the sodium hydroxide added previously, is subjected to rectification at vacuum (2 mm Hg) for obtaining 55 g of spindle oil (SN-80), 400 g of light base oil (SN-150) and 235 g of heavy base oil (SN 350), leaving 200 g as a bottom. The recovery in lubricant bases is 67% in weight of used oil on a dry basis.

The base oils obtained have characteristics typical of virgin base oils and comply with the normal specifications of these products, without the need for further treatments, as shown below:

| | SN-150 | SN-350 | SN-80 |
|---|---|---|---|
| Colour (ASTM D 1500) | 0.5+ | 1.5 | 0.5 |
| Viscosity cSt at 40° C. (ASTM D445) | 24 | 56 | 8.7 |
| Acidity mg KOH/g (ASTM D664) | 0.02 | 0.03 | 0.00 |
| Water % (Karl Fisher) | <0.01 | <0.01 | <0.01 |
| Flash point ° C. (ASTM D92) | 236 | 243 | — |
| Ramsbottom Carbon % (ASTM D524) | <0.05 | <0.05 | <0.05 |

Example No. 2 demonstrates that demetallization followed by distillation, both carried out under moderate temperature conditions and in the presence of an alkaline hydroxide, as specified in the present invention, produces base oils with characteristics of base oils of first refining.

The invention claimed is:

1. Method for the regeneration of used mineral oils for obtaining lubricant bases which comprises the following steps:

(a) demetallization of the used mineral oil by means of chemical treatment of said oil with an aqueous solution of a chemical reagent containing anions which form low solubility salts with the metals of the oil, followed by the separation of the demetallized oil;

(b) distillation of the demetallized oil obtained in step (a) at atmospheric pressure and in the presence of alkaline hydroxides; and (c) distillation of the bottom liquid obtained in the atmospheric distillation of step (b) under vacuum and in the presence of alkaline hydroxides to obtain lubricant bases.

2. Method according to claim 1, characterised in that the chemical reagent employed in (a) is an ammonium salt; and in that said reagent is used in a proportion of 0.5% to 5% by weight of ammonium salt in relation to the used oil.

3. Method according to claim 2, characterised in that the ammonium salt contains anions of the phosphate and sulphate groups, and can be monoammonium or diammonium phosphate, or monoammonium or diammonium sulphate, or a mixture thereof.

4. Method according to claim 1, characterised in that in step (a) the chemical treatment is carried out in a continuous way in tubular reactors, or in one or several well-mixed reactors in series, or a combination of both systems; and where the reaction is carried out at temperatures between 120° C. and 180° C., at pressures between 3 bar and 11 bar and with residence times in the reactors between 10 minutes and 120 minutes.

5. Method according to claim 1, characterised in that in step (a) the separation is carried out continuously by means of a flash vaporisation, so that at least a part of the water and the light hydrocarbons and solvents are vaporised, which are collected and decanted after their condensation, and a liquid is obtained, which after cooling down, is separated into a sludge containing the metal salts, an aqueous phase with the excess reagent and the demetallized oil.

6. Method according to claim 5, characterised in that the separation of the sludge containing the metal salts, the aqueous phase with the excess reagent and the demetallized oil is carried out by continuous centrifugation in one or two steps in series.

7. Method according to claim 1, characterised in that in step (b) the demetallized oil is distilled continuously at atmospheric pressure in the presence of alkaline hydroxides, so that the remains of water, light hydrocarbons and solvents are distilled, along with the ammonia released by the effect of the alkaline hydroxides.

8. Method according to claim 7, characterised in that the distillate is subjected to condensation, followed by decanting, in such a way that an organic phase is obtained which contains light hydrocarbons and solvents and an aqueous phase which contains ammonia.

9. Method according to claim 8, characterised in that the non-condensables of the distillate are washed with water or with an aqueous solution of an acid to keep the ammonia in aqueous solution, which is added to the aqueous phase obtained in claim 8.

10. Method according to claim 7, characterised in that the atmospheric distillation is carried in a continuous way by flash vaporisation at temperatures between 200° C. and 300° C.

11. Method according to claim 1, characterised in that in step (c) the bottom liquid obtained in the atmospheric distillation of step (b) is vacuum distilled in a rectification column in a continuous way in the presence of alkaline hydroxides, preferably at a pressure between 2 mbar and 10 mbar at the top of the column and a column feed temperature between 310° C. and 335° C., for obtaining a vacuum gas-oil or several fractions of lubricant bases as side cuts and a bottom with characteristics of fuel-oil or an asphalt component.

12. Method according to claim 1, characterised in that the distillations of steps (b) and (c) are carried out in tubular heat exchangers, in which the demetallized oil obtained in step (a), or the bottom liquid obtained by atmospheric distillation in step (b), circulates at high speed inside the tubes and in which the heating fluid on the outside of these tubes is a thermal oil which circulates preferably at temperatures below 300° C. in the atmospheric distillation and below 385° C. in the vacuum distillation.

13. Method according to claim 1, characterised in that the alkaline hydroxide employed in steps (b) and (c) is sodium hydroxide or potassium hydroxide, or a mixture of both, which is added preferably in a proportion of 0.5% to 5% in weight in relation to the demetallized oil, more preferably in a proportion of 0.5% to 3%, so that said addition is carried out completely before the atmospheric distillation, or a part before the atmospheric distillation and a part before the vacuum distillation.

* * * * *